US008939573B2

(12) United States Patent
Kanasugi et al.

(10) Patent No.: US 8,939,573 B2
(45) Date of Patent: Jan. 27, 2015

(54) TRANSFER INK JET RECORDING METHOD

(75) Inventors: Yuichiro Kanasugi, Tokyo (JP); Shinsuke Tsuji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 528 days.

(21) Appl. No.: 13/283,154

(22) Filed: Oct. 27, 2011

(65) Prior Publication Data

US 2012/0127250 A1 May 24, 2012

(30) Foreign Application Priority Data

Nov. 18, 2010 (JP) ..... 2010-258193

(51) Int. Cl.
*B41J 2/01* (2006.01)
*B41J 2/005* (2006.01)
*B41J 2/21* (2006.01)

(52) U.S. Cl.
CPC ..... *B41J 2/0057* (2013.01); *B41J 2/2107* (2013.01)
USPC ..... 347/103; 347/96; 347/100

(58) Field of Classification Search
CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101
USPC ..... 347/103, 100, 101, 95, 96, 102; 106/31.6, 31.13, 31.27; 523/160, 161
See application file for complete search history.

(56) References Cited

U.S. PATENT DOCUMENTS

| | | | | |
|---|---|---|---|---|
| 8,042,906 | B2 | 10/2011 | Chiwata et al. | |
| 2006/0189716 | A1* | 8/2006 | Ushirogouchi et al. | 523/160 |
| 2006/0250463 | A1* | 11/2006 | Nakazawa et al. | 347/100 |
| 2007/0172608 | A1* | 7/2007 | Tojo et al. | 428/32.38 |
| 2009/0027473 | A1 | 1/2009 | Taniuchi et al. | |
| 2009/0041932 | A1* | 2/2009 | Ishizuka et al. | 427/152 |
| 2009/0087565 | A1 | 4/2009 | Houjou | |

FOREIGN PATENT DOCUMENTS

| | | | |
|---|---|---|---|
| JP | 2000-343808 | A | 12/2000 |
| JP | 2003-246135 | A | 9/2003 |
| JP | 2008-018719 | A | 1/2008 |
| JP | 2008-221529 | A | 9/2008 |
| JP | 2009-083324 | A | 4/2009 |
| JP | 2009-096175 | A | 5/2009 |

* cited by examiner

*Primary Examiner* — Manish S Shah
(74) *Attorney, Agent, or Firm* — Fitzpatrick, Cella, Harper & Scinto

(57) ABSTRACT

Provided is a transfer ink jet recording method, which provides satisfactory transferability and satisfactory wet scratch resistance of a final image even at high printing duty. The transfer ink jet recording method includes using an aggregation liquid, in which the aggregation liquid includes a polymer compound including one of a polyamino acid and a polyamino acid salt each having an amino group, each of which is obtained by polymerization of an amino acid compound represented by the general formula (1).

General formula (1)

11 Claims, 1 Drawing Sheet

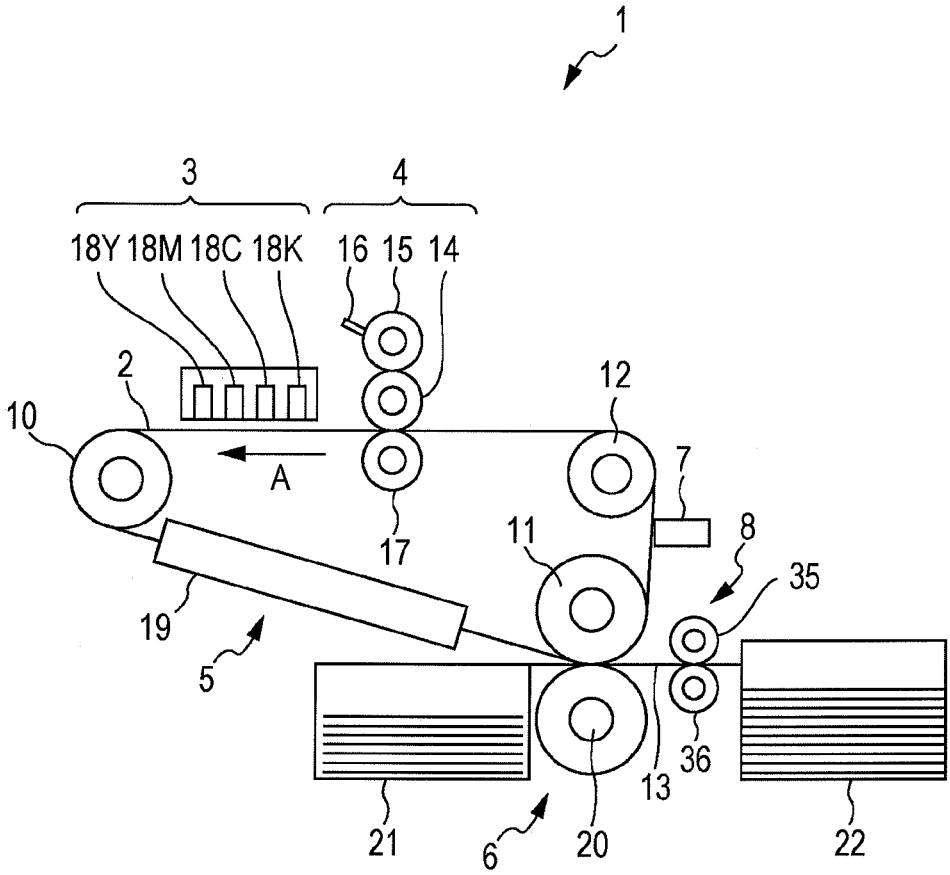
1
3
4
18Y 18M 18C 18K
16 15 14
2
10
12
A
7
17
11
8
35
19
5
36
13
21
6
20
22

TRANSFER INK JET RECORDING METHOD

BACKGROUND OF THE INVENTION

1. Field of the Invention

The present invention relates to a transfer ink jet recording method.

2. Description of the Related Art

As a printing system, there is known a recording method including forming an intermediate image on an intermediate transfer member by an ink jet recording method and transferring the intermediate image to a recording medium to form a final image (transfer ink jet recording method). In the transfer ink jet recording method, in order to improve image performance and water resistance, there is known a method including applying an aggregation liquid for aggregating ink to an intermediate transfer member (see Japanese Patent Application Laid-Open No. 2003-246135). The method described in Japanese Patent Application Laid-Open No. 2003-246135 includes aggregating ink on an intermediate transfer member with an aggregation liquid containing a cationic polymer such as a dicyandiamide resin or a polyallylamine to suppress bleeding (ink color mixing) and enhance image performance. In addition, the method improves the coating film strength of an image and improves water resistance by increasing the molecular weight of a cationic substance.

SUMMARY OF THE INVENTION

However, according to studies made by the inventors of the present invention, the recording method described in Japanese Patent Application Laid-Open No. 2003-246135 involves the following problems. First, there is a problem in that the method does not provide satisfactory transferability at the time of transferring an intermediate image on an intermediate transfer member to a recording medium, with the result that a final image to be formed on the recording medium is disturbed. This is probably because the aggregation property of ink for forming the intermediate image is deficient and the internal aggregation force of the intermediate image necessary during transfer becomes insufficient at a high printing duty. Such reduction in transferability is particularly remarkable in the case of using, as the recording medium, uncoated paper sheet or the like having a relatively large surface roughness.

In addition, there is a problem in that the scratch resistance in the case where water is attached to printed articles as required of commercial printed articles or the like is insufficient. The commercial printed articles may be used by wiping off water after the water has adhered to the printed articles and left to stand. The scratch in such state in which water is attached is referred to as "wet scratch." When printed articles obtained by the recording method described in Japanese Patent Application Laid-Open No. 2003-246135 is subjected to this wet scratch, an image may be remarkably disturbed owing to the occurrence of scratch marks in the image. This is probably because when water is left to stand on printed articles having an image formed thereon, the water permeates a printing surface and causes the swelled deterioration of the printing surface, and when the water is subjected to a scratch wiping operation in such state, the printing surface that has undergone the swelling deterioration is peeled off.

Further, when color ink is used as the ink, the formation of a high-density image having a high printing duty causes bleeding in some cases. This is probably because the use of only a cationic polymer (aggregating agent) as a component for aggregating ink does not provide a sufficient aggregation force, which makes it difficult to sufficiently aggregate ink used for forming an intermediate image in the case where the amount of an ink is large with respect to the amount of an aggregation liquid per unit area.

Accordingly, an object of the present invention is to provide a transfer ink jet recording method, which provides satisfactory transferability and satisfactory wet scratch resistance of a final image even at high printing duty.

The above-mentioned object is solved by the present invention described below. That is, the present invention is a transfer ink jet recording method, including forming an intermediate image by applying ink including an anionic component to an image formation surface of an intermediate transfer member to which an aggregation liquid including an aggregating agent for aggregating the anionic component in the ink has been applied by an ink jet recording method, and transferring the intermediate image from the image formation surface having the intermediate image formed thereon to a recording medium by pressing the recording medium to the image formation surface, in which the aggregation liquid further includes a polymer compound including one of a polyamino acid and a polyamino acid salt each having an amino group, each of which is obtained by polymerization of an amino acid compound represented by the following general formula (1):

General formula (1)

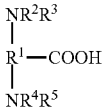

where $R^1$ represents a trivalent organic group; $R^2$, $R^3$, $R^4$, and $R^5$ each represent hydrogen or a monovalent organic group; and at least one of $R^2$, $R^3$, $R^4$, and $R^5$ represents hydrogen.

According to the present invention, the transfer ink jet recording method, which provides satisfactory transferability and satisfactory wet scratch resistance of a final image even at a high printing duty, can be provided.

Further features of the present invention will become apparent from the following description of exemplary embodiments with reference to the attached drawings.

BRIEF DESCRIPTION OF THE DRAWINGS

FIGURE is a diagram illustrating an example of an image recording apparatus with which an ink jet recording method of the present invention is performed.

DESCRIPTION OF THE EMBODIMENTS

Preferred embodiments of the present invention will now be described in detail in accordance with the accompanying drawings.

<Ink>

Ink to be used in a transfer ink jet recording method of the present invention contains an anionic component.

Examples of the anionic component include a component showing a negative charge. Preferred examples of the anionic component include a carboxylic acid, a sulfonic acid, and a phosphonic acid, and compounds having anionic groups in which those acids are neutralized with a metal salt and an organic amine. The anionic component is preferably a polymer. This is because when a component which forms an ionic bond with a cationic component in an aggregation liquid is a polymer, the coating film strength increases and the wet scratch resistance becomes satisfactory. In the present invention, the polymer used as the anionic component is preferably a dispersant for dispersing a coloring material. When the polymer is a dispersant for dispersing a coloring material, the weight average molecular weight of the polymer is preferably 1,000 or more and 50,000 or less. Further, when the polymer is an emulsion particle, the weight average molecular weight of the polymer is preferably 1,000 or more and 10,000,000 or less.

In the present invention, the anionic component may be a pigment having an anionic functional group, or may be an anionic dye.

The ink of the present invention may contain a functional additive in order to additionally improve fastness properties of a final image. Examples of the functional additive include conventionally known water-soluble resins and water-insoluble resin fine particles. A material used for the ink is not limited as long as the material can coexist with other ink components. The water-insoluble resin fine particles mean fine particles of a water-insoluble polymer which can be present in a dispersed state in an aqueous medium by use of a functional group (in particular, acidic group or salt thereof) possessed by the water-insoluble polymer itself, and which does not contain any free emulsifier. Examples of the water-insoluble polymer include the water-insoluble polymer described in Japanese Patent Application Laid-Open No. 2009-096175.

The ink of the present invention may be clear ink which does not contain any coloring material, or may be color ink which contains a coloring material. As the coloring material contained in the ink, there may be used the conventionally known dye and pigment as described in Japanese Patent Application Laid-Open No. 2008-018719. Further, the dispersant as described in Japanese Patent Application Laid-Open No. 2008-018719 may be used for dispersing the coloring material.

The ink of the present invention preferably contains water and an organic solvent. The organic solvent is preferably a water-soluble material having a high boiling point and a low vapor pressure as described below. For example, there are given polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether, and glycerin. Those may be used alone or in combination of two or more kinds thereof. Further, an alcohol such as ethyl alcohol or isopropyl alcohol or a surfactant may be added in the ink as a component for adjusting the viscosity, surface tension, or the like.

The blending ratios of components which constitute the ink of the present invention are not particularly limited, and can be appropriately adjusted in such a range that ejection can be performed depending on the ejection force, nozzle diameter, and the like of an ink jet head to be selected. It is preferred that the blending ratios of the coloring material, the organic solvent, and the surfactant be 0.1 mass % or more and 10 mass % or less, 5 mass % or more and 40 mass % or less, and 0.01 mass % or more and 5 mass % or less, respectively, with respect to 100 mass % of the total amount of the ink. Then, the balance is adjusted with water. The ink of the present invention is preferably aqueous ink containing water in an amount of 40 mass % or more.

<Aggregation Liquid>

An aggregation liquid to be used in the transfer ink jet recording method of the present invention contains an aggregating agent. Further, the aggregation liquid contains a polymer compound including a polyamino acid or a polyamino acid salt having an amino group, which is obtained by polymerization of the amino acid compound represented by the general formula (1).

It is important that the aggregating agent has a function of aggregating the anionic component in the ink and can coexist with the polymer compound in the aggregation liquid. Such aggregating agent is preferably a metal salt which generates a metal ion or an acidic compound which changes hydrogen ion concentration (pH). Of those, an acidic compound is more preferred from the viewpoint of coexistence stability with a polymer compound including a cationic component.

As the metal salt, for example, a metal salt which generates a polyvalent metal ion as described below is used. That is, examples of the metal ion include divalent metal ions such as $Ca^{2+}$, $Cu^{2+}$, $Ni^{2+}$, $Mg^{2+}$, and $Zn^{2+}$ and trivalent metal ions such as $Fe^{3+}$ and $Al^{3+}$. In addition, in the case of applying a liquid containing those metal salts, it is preferred to apply the liquid as a metal salt aqueous solution. A metal salt anion is exemplified by $Cl^-$, $NO_3^-$, $SO_4^{2-}$, $I^-$, $Br^-$, $ClO_3^-$, or $RCOO^-$ (R represents a monovalent organic group).

The acidic compound preferably has a pH buffering ability from the viewpoint of aggregation performance of ink, and preferably has an acid dissociation constant (pKa) of 4.5 or less. When the acid dissociation constant is more than 4.5, the aggregation performance lowers, which makes it difficult to sufficiently form a complex aggregate of the anionic component in the ink and the aggregating agent and the polymer compound in the aggregation liquid. Examples of the acidic compound include organic carboxylic acids and organic sulfonic acids. More specific examples thereof include polyacrylic acid, acetic acid, methanesulfonic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, levulinic acid, derivatives of those compounds, and salts thereof.

One kind of the above-mentioned metal salts or acidic compounds may be used alone, or two or more kinds thereof may be used in combination. The content of the aggregating agent in the aggregation liquid is preferably 0.01 mass % or more and 90 mass % or less with respect to the total mass of the aggregation liquid. The content is more preferably 1 mass % or more, still more preferably 10 mass % or more. Further, the content is more preferably 80 mass % or less, still more preferably 70 mass % or less. When the content is less than 0.01 mass %, the anionic component may not sufficiently aggregate. When the content is more than mass %, in some kinds of aggregating agents, the aggregating agents may be present non-uniformly as insoluble matter in the aggregation liquid, which may make it difficult to apply the aggregation liquid and form an intermediate image.

The aggregation liquid contains a polymer compound including a polyamino acid or a polyamino acid salt having an amino group, which is obtained by polymerization of the amino acid compound represented by the general formula (1) (hereinafter, referred to as polymer compound of the present invention):

general formula (1)

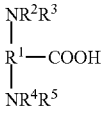

where $R^1$ represents a trivalent organic group; $R^2$, $R^3$, $R^4$, and $R^5$ each represent hydrogen or a monovalent organic group; and at least one of $R^2$, $R^3$, $R^4$, and $R^5$ represents hydrogen.

In the general formula (1), the organic group is a carbon-containing group. $R^1$ in the general formula (1) represents a trivalent organic group, and examples of the trivalent organic group include a trivalent hydrocarbon group. Further, $R^2$, $R^3$, $R^4$, and $R^5$ each represent hydrogen or a monovalent organic group, and examples of the monovalent organic group include a monovalent hydrocarbon group. Those hydrocarbon groups may have another atom such as nitrogen or may have a functional group. The polymer compound of the present invention, which is obtained by polymerization of the amino acid compound represented by the general formula (1), has an amino group. In addition, the polymer compound of the present invention preferably has an amine value of 5.0 mmol/g or more and 16.0 mmol/g or less. The amine value is more preferably 6.0 mmol/g or more, still more preferably 7.0 mmol/g or more. Further, the amine value is more preferably 10.0 mmol/g or less, still more preferably 9.0 mmol/g or less. When the amine value is less than 5.0 mmol/g, the polymer compound cannot sufficiently form an ionic bond with the anionic component in the ink, and hence the coating properties of an intermediate image to be pressed on a recording medium may lower and the transferability may lower. Further, when an excessive amount of a hydrophilic anionic component derived from ink remains in a final image on a recording medium, the wet scratch resistance may lower. When the amine value is more than 16.0 mmol/g, hydrophilic amino groups of a polyamino acid or a polyamino acid salt are liable to remain in a final image in an excessive amount with respect to an anionic component in color ink particularly in the case where printing is performed at a low duty. Thus, the wet scratch resistance may lower. The amine value is preferably 1.0 time or more, more preferably 1.5 times or more as large as the total acid value of the anionic component in the ink. Further, the amine value is preferably 10.0 times or less, more preferably 9.0 times or less, particularly preferably 2.5 times or less as large as the total acid value of the anionic component in the ink.

The weight average molecular weight of the polymer compound of the present invention is preferably 1,000 or more, more preferably 2,000 or more, still more preferably 3,000 or more. Further, the weight average molecular weight is preferably 1,000,000 or less, more preferably 500,000 or less, still more preferably 300,000 or less. When the weight average molecular weight is less than 1,000, the coating properties of the intermediate image may lower and the transferability may lower. Further, the scratch resistance, particularly wet scratch resistance of printed articles may lower. When the weight average molecular weight is more than 1,000,000, the viscosity of the aggregation liquid rapidly increases along with an increase in addition amount of the polymer compound in the aggregation liquid, which may make it difficult to satisfactorily apply the aggregation liquid to the intermediate transfer member.

The content of the polymer compound of the present invention in the aggregation liquid is preferably 1 mass % or more and 90 mass % or less with respect to the total mass of the aggregation liquid. The content is more preferably 5 mass % or more, still more preferably 10 mass % or more. Further, the content is more preferably 70 mass % or less, still more preferably 50 mass % or less. When the content is less than 1 mass %, the transferability, the wet scratch resistance, and the like are not satisfactory in some cases. When the content is more than 90 mass %, the addition amount of the aggregating agent becomes small, and hence the aggregation property of the anionic component may lower and the image performance and transferability of the intermediate image may lower.

The polymer compound of the present invention may be present in a dissolved or dispersed state in the aggregation liquid. When the polymer compound of the present invention is present in a dispersed state, the polymer compound preferably is not in a particle state but in a state in which particles are formed into a coating film in a final image after transfer. That is, in the fixing step of printed articles, it is preferred to sufficiently form particles into a coating film by heating at a temperature equal to or more than the lowest film formation temperature of the particles (polymer compound). When the polymer compound is in a particle state in the final image, particularly when the particle diameter is large, the presence of the particles causes light scattering, with the result that the glossiness of the final image may lower or the water resistance may lower. One kind of the polymer compound of the present invention may be used alone, or two or more kinds thereof may be used in combination. Further, the polymer compound may be allowed to coexist with other various additives.

Specific examples of the polymer compound of the present invention include polymer compounds as described below. That is, there are given polymers of, for example, lysine, ornithine, arginine, asparagine, histidine, glutamine, and tryptophan, and salts obtained by salifying those polymers with acids or the like.

The aggregation liquid of the present invention preferably contains, for example, water, an organic solvent, and an additive. The organic solvent is preferably any of aqueous organic solvents as described below. For example, there are given polyethylene glycol, polypropylene glycol, ethylene glycol, propylene glycol, butylene glycol, triethylene glycol, thiodiglycol, hexylene glycol, diethylene glycol, pentanediol, ethylene glycol monomethyl ether, diethylene glycol monomethyl ether, and glycerin.

The use of the aggregation liquid of the present invention can form a final image satisfactory in transferability and wet scratch resistance even at a high printing duty. Further, in the case of color ink, the occurrence of bleeding can be suppressed. The inventors of the present invention have estimated the reason for this as described below. Three components, i.e., the anionic component in the ink and the aggregating agent and the polymer compound in the aggregation liquid synergistically act on each other during forming the intermediate image on the intermediate transfer member, and as a result, a complex aggregation reaction occurs. Thus, aggregation performance enough to suppress the occurrence of bleeding and the like can be expressed irrespective of the amount of the ink. Further, the intermediate image obtained by the complex aggregation reaction forms an aggregate having a specifically high molecular weight and provides very satisfactory transferability. Further, the final image after transfer to the recording medium forms a specific three-dimensional crosslinked structure through an intermolecular force peculiar to a peptide bond included in the polymer compound of the present invention and an ionic bond of the above-mentioned three components after the removal of water and a solvent. Thus, satisfactory wet scratch resistance is expressed. That is, this can suppress the permeability of water into a film, the swelled deterioration of the final image by water, and film peeling due to the subsequent water wiping operation.

<Transfer Ink Jet Recording Method and Image Recording Apparatus>

Next, the constitution of each of the transfer ink jet recording method and the image recording apparatus of the present invention is described.

FIGURE is a schematic diagram illustrating the schematic construction of one example of the image recording apparatus of the present invention. An image recording apparatus 1 is mainly constructed of an intermediate transfer member 2, an ink ejecting portion 3, an aggregation liquid applying portion 4, a solvent removing portion 5, and a transferring portion 6, and further includes a cleaning portion 7 and an image fixing portion 8. The intermediate transfer member 2 is constructed of an endless belt having a predetermined width and has such a structure that it is wound around multiple rollers 10, 11, and 12. It is constructed so that power of motor (not shown) is transmitted to at least one main roller of the multiple rollers 10, 11, and 12, and the intermediate transfer member 2 is rotated in the direction of the arrow A of FIGURE (hereinafter, transfer member rotational direction) outside of each of the rollers 10, 11, and 12 by the driving of the motor. The respective units arranged in the periphery, i.e., the ink ejecting portion 3, the aggregation liquid applying portion 4, the solvent removing portion 5, the transferring portion 6, the cleaning portion 7, and the image fixing portion 8 operate in synchronization with the rotation. In this embodiment, a polyurethane belt is used as a support member for the intermediate transfer member 2 from the viewpoints of strength enough to resist pressurization at the time of transfer and dimensional accuracy. The support member for the intermediate transfer member 2 may be any support member as long as the surface layer of the intermediate transfer member 2 can at least be in line contact with a recording medium 13, and is selected depending on the mode of an image recording apparatus to be applied or the mode of transfer to the recording medium 13. For example, a support member having a roller shape or a drum shape may also be suitably used.

It is important that the intermediate transfer member 2 has characteristics of forming an intermediate image through application of ink, and further transferring the formed intermediate image to a recording medium to form a satisfactory final image. Further, when the transferability is high, the use efficiency of ink to be used is satisfactory. As a result, the amount of ink to be wasted is reduced and simultaneously a load on the cleaning unit is reduced. The surface of the intermediate transfer member 2 for that purpose is preferably an ink non-absorption surface, more preferably an ink non-adhesion surface. In addition, the surface preferably has elasticity which allows following and sufficiently contacting the surface of a recording medium such as paper. The material satisfying those characteristics is exemplified by various plastics and rubbers. In particular, silicone rubber, fluorosilicone rubber, fluororubber, and the like are suitably used from the viewpoint of non-adhesion property. Those rubbers have low surface energy and hence may be poor in ink accepting property, and hence it is recommended to perform surface treatment depending on ink to be used. Examples of the surface treatment include chemical treatment involving using a chemical, physical treatment involving changing a surface shape, and energy irradiation treatment involving irradiation with ultraviolet light or plasma. In the present invention, a combination of an intermediate transfer member having a contact angle with an aggregation liquid to be used of 10° or more and 100° or less and the aggregation liquid is extremely suitably used.

In the aggregation liquid applying portion 4, a roll coater using an aggregation liquid applying roll 14, an aggregation liquid supplying roll 15, an aggregation liquid amount controlling blade 16, and a counter roll 17 is disposed as a unit for applying an aggregation liquid to the intermediate transfer member 2. This is such a construction that an aggregation liquid forming an aggregate through contact with an anionic component in ink is applied to the surface (image formation surface) of the intermediate transfer member 2. The aggregation liquid may be applied by any technique such as a spray coater, a squeegee, or an ink jet recording method.

After the aggregation liquid has been applied at the aggregation liquid applying portion 4, ink is applied from the ink ejecting portion 3 to the image formation surface of the intermediate transfer member 2 by an ink jet recording method. Thus, an intermediate-image-forming step of forming an intermediate image (mirror image) on the image formation surface of the intermediate transfer member 2 is performed. The ink ejecting portion 3 is disposed on the downstream side in the transfer member rotational direction of the aggregation liquid applying portion 4. The ink ejecting portion 3 is provided with recording heads 18K, 18C, 18M, and 18Y corresponding to inks of black (K), cyan (C), magenta (M), and yellow (Y) colors. The respective recording heads 18K, 18C, 18M, and 18Y eject the corresponding color inks in response to an external image signal from an ejection surface opposed to the intermediate transfer member 2. Thus, each color ink is applied to the image formation surface of the intermediate transfer member 2. It should be noted that, as the ink ejecting portion 3, there may also be used one that performs ink ejection with not only a continuous mode but also an on-demand mode using an electrothermal transducing element (heat generating element), an electromechanical transducing element (piezoelectric element), or the like. As the form of the ink ejecting portion 3, for example, as to the construction of FIGURE, there may be used a recording head of a line head form in which ink ejection orifices are arrayed in a direction orthogonal to the FIGURE. Further, a recording head in which ejection orifices are arrayed in a predetermined range in a tangential or circumferential direction of the intermediate transfer member 2 may be used, and recording may be performed while scanning the recording head in an axis direction. In addition, the number of recording heads may also be determined depending on ink colors used for image formation.

In the solvent removing portion 5, a drying furnace 19 provided with a heating air blower (not shown) is disposed in order to remove a liquid component from the intermediate image formed on the image formation surface of the intermediate transfer member 2 until a state in which satisfactory transfer can be achieved. When a decrease in liquid component is insufficient, an excessive liquid in the subsequent step, i.e., the transferring step, flows out, which may disturb an image and cause a reduction in transferability. Any of various conventionally used techniques is suitably applicable as a technique for decreasing the liquid component. Specifically, a technique including using heat-induced evaporation, a technique including blowing drying air, a technique including absorbing liquid with an absorbing member, a combination of those techniques, or the like is suitably employed.

Next, a transferring step of transferring the intermediate image from the image formation surface to the recording medium 13 by pressing the recording medium 13 on the image formation surface having formed thereon the intermediate image is performed. In the exemplary apparatus of FIGURE, pressurization is performed so that the intermediate transfer member 2 and the recording medium are sandwiched between the roller 11 and a pressurization roller 20, thereby achieving efficient image transfer. According to this embodiment, at this stage, the liquid component in the ink has been already decreased on the intermediate transfer member 2, the ink has a high viscosity, and hence a satisfactory final image can be formed even in the case of using a recording medium having low ink absorptivity such as coated paper.

In the conveying portion, the recording medium 13 is conveyed from a paper feeding tray 21 to a paper ejection tray 22 through the transferring portion 6. As a conveying mechanism for cut paper sheets, for example, one using a roller and a guide is employed. In order to suppress the occurrence of double feeding or the like of the recording medium 13 and stably perform the conveyance, there may be employed a mechanism in which air is blown from the side surface of recording media stacked in the tray, thereby facilitating the conveyance of the recording medium 13. Further, in order to prevent the elongation and contraction due to a change in humidity of the recording medium 13, a temperature controlling mechanism may be employed. As the shape of the recording medium 13, a cut sheet was used in this embodiment. However, a continuous sheet having a roll shape may also be used.

The image fixing portion 8 is disposed on the recording medium ejection side of the transferring portion (right side of FIGURE). In the image fixing portion 8, two fixing rollers 35 and 36 are provided on front and back surfaces of the recording medium 13. The image transferred to and formed on the recording medium 13 can be pressurized and heated with those fixing rollers 35 and 36, thereby improving the fixability of the recorded image on the recording medium 13. It should be noted that the fixing rollers 35 and 36 are preferably a pair of rollers formed of one pressurization roller and one heating roller.

EXAMPLES

Hereinafter, examples and comparative examples of the present invention are described. However, the present invention is by no means limited thereto. It should be noted that the term "part(s)" is on the mass basis in all of the following descriptions.

<Ink>

Pigments shown in Table 1 below were used as coloring materials. It should be noted that Coloring material 5 is an oxidation product of carbon black MCF88 obtained by subjecting the carbon black to known oxidation reaction treatment with hypochlorous acid, and is an anionic component.

TABLE 1

| Coloring material | Name |
|---|---|
| 1 | Carbon black: MCF88 (manufactured by Mitsubishi Chemical Corporation) |
| 2 | Pigment Blue 15 (manufactured by Dainichiseika Color & Chemicals Mfg. Co., Ltd.) |
| 3 | Pigment Red 7 (manufactured by Dainichiseika Color & Chemicals Mfg. Co., Ltd.) |
| 4 | Pigment Yellow 74 (manufactured by Dainichiseika Color & Chemicals Mfg. Co., Ltd.) |

TABLE 1-continued

| Coloring material | Name |
|---|---|
| 5 | Oxidation product of carbon black MCF88 (acid value: 0.8 mmol/g) |

A salt of a styrene-methacrylic acid-benzyl acrylate copolymer neutralized with potassium hydroxide (weight average molecular weight: 8,700, acid value: 3.9 mmol/g, anionic component) was used as a water-soluble resin (dispersant). The water-soluble resin was obtained by polymerization according to the method described in Japanese Patent Application Laid-Open No. 2009-096175.

Each of the coloring materials and the dispersant were used and fed into a batch type vertical sand mill (manufactured by AIMEX CO, Ltd.), glass beads having a diameter of 1 mm were put as media, and the whole was cooled with water and subjected to dispersion treatment for 3 hours. The dispersion liquid was centrifuged to remove coarse particles, and an ink including a coloring material having a weight average particle diameter of 100 to 200 nm was prepared according to each of compositions shown in Table 2 below. The total acid value was measured using an automatic potentiometric titrator (AT-510 manufactured by Kyoto Electronics Manufacturing Co., Ltd.).

TABLE 2

| | Coloring material | | Dispersant | | Diethylene glycol | Water | Surfactant (Acetylenol E100) | Total acid |
|---|---|---|---|---|---|---|---|---|
| | Type | Amount <parts> | Type | Amount <parts> | Amount <parts> | Amount <parts> | Amount <parts> | value <mmol/g> |
| Black ink 1 | 1 | 2 | 1 | 2 | 10 | 85 | 1 | 3.9 |
| Cyan ink 1 | 2 | 2 | 1 | 2 | 10 | 85 | 1 | 3.9 |
| Yellow ink 1 | 3 | 2 | 1 | 2 | 10 | 85 | 1 | 3.9 |
| Magenta ink 1 | 4 | 2 | 1 | 2 | 10 | 85 | 1 | 3.9 |
| Black ink 2 | 5 | 2 | — | — | 10 | 85 | 1 | 0.8 |

<Aggregation Liquid>

Polymer compounds shown in Table 3 below were each used as the polymer compound contained in the aggregation liquid. The amine value was calculated based on the structure of a monomer. Structures of monomers for the respective polymer compounds are as shown in Table 4.

TABLE 3

| | Compound name | Weight average molecular weight | Amine value <mmol/g> |
|---|---|---|---|
| Polymer compound 1 | Polylysine (manufactured by JNC CORPORATION: solid content: 25 mass %) | 4,000 | 7.8 |
| Polymer compound 2 | Polyornithine hydrochloride (manufactured by Sigma-Aldrich Corporation, solid content: 100 mass %) | 15,000 to 30,000 | 6.6 |
| Polymer compound 3 | Polyarginine hydrochloride (manufactured by Sigma-Aldrich Corporation, solid content: 100 mass %) | 5,000 to 15,000 | 15.6 |
| Comparative polymer compound 1 | Dicyandiamide-diethylenetriamine polycondensate (trade name: UNISENCE KHP10P manufactured by SENKA corporation, solid content: 100%) | — | 23.8 |

TABLE 3-continued

| | Compound name | Weight average molecular weight | Amine value <mmol/g> |
|---|---|---|---|
| Comparative polymer compound 2 | Polyallylamine hydrochloride (trade name: PAA-HCL-05 manufactured by NITTO BOSEKI CO., LTD., solid content: 40%) | 5,000 | 10.7 |

TABLE 4

| | Monomer for polymer compound |
|---|---|
| Polymer compound 1 | 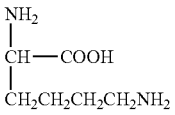 |
| Polymer compound 2 | 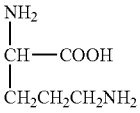 |
| Polymer compound 3 | 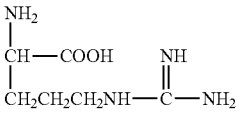 |

TABLE 4-continued

| | Monomer for polymer compound |
|---|---|
| Comparative polymer compound 1 | 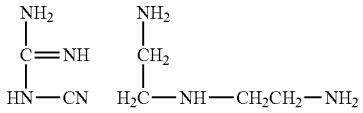 |
| Comparative polymer compound 2 | 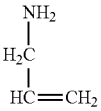 |

Each of the polymer compounds was identified by employing $^{13}$C-NMR spectrometry (used apparatus; Avance 500 (trade name) manufactured by Bruker Co.), $^{1}$H-NMR spectrometry (used apparatus; Avance 500 (trade name) manufactured by Bruker Co.), and infrared spectroscopy (used apparatus; Spectrum One (trade name) manufactured by Perkin Elmer Co.). As a result, Polymer compounds 1, 2, and 3 were each found to be a polymer compound including a polyamino acid or a polyamino acid salt having an amino group, which is obtained by polymerization of the amino acid compound represented by the general formula (1). On the other hand, Comparative polymer compounds 1 and 2 were each found not to be the polymer compound of the present invention.

Aggregation liquids shown in Table 5 below were prepared using the above-mentioned polymer compounds. It should be noted that glutaric acid has a pKa of 4.1 and acetic acid has a pKa of 4.8 in the table.

TABLE 5

| | Polymer compound | | Aggregating agent | | Organic solvent | | Surfactant | | |
|---|---|---|---|---|---|---|---|---|---|
| | Type | Amount <parts> | Type | Amount <parts> | Type | Amount <parts> | Type | Amount <parts> | Water <parts> |
| Aggregation liquid 1 | Polymer compound 1 | 40 | Glutaric acid | 35 | 1,5-Pentanediol | 15 | Acetylenol E100 | 1 | 9 |
| Aggregation liquid 2 | Polymer compound 2 | 10 | Glutaric acid | 35 | 1,5-Pentanediol | 15 | Acetylenol E100 | 1 | 39 |
| Aggregation liquid 3 | Polymer compound 3 | 10 | Glutaric acid | 35 | 1,5-Pentanediol | 15 | Acetylenol E100 | 1 | 39 |
| Aggregation liquid 4 | Polymer compound 1 | 40 | Calcium nitrate | 35 | 1,5-Pentanediol | 15 | Acetylenol E100 | 1 | 9 |
| Aggregation liquid 5 | Polymer compound 1 | 40 | Acetic acid | 35 | 1,5-Pentanediol | 15 | Acetylenol E100 | 1 | 9 |
| Comparative aggregation liquid 1 | Comparative polymer compound 1 | 10 | Glutaric acid | 35 | 1,5-Pentanediol | 15 | Acetylenol E100 | 1 | 39 |
| Comparative aggregation liquid 2 | Comparative polymer compound 2 | 25 | Glutaric acid | 35 | 1,5-Pentanediol | 15 | Acetylenol E100 | 1 | 24 |
| Comparative aggregation liquid 3 | Polymer compound 1 | 40 | — | — | 1,5-Pentanediol | 15 | Acetylenol E100 | 1 | 44 |
| Comparative aggregation liquid 4 | — | — | Glutaric acid | 35 | 1,5-Pentanediol | 15 | Acetylenol E100 | 1 | 49 |

<Recording Method>

Printed articles having a final image formed thereon was obtained by the following transfer ink jet recording method using the above-mentioned ink and aggregation liquid.

(A) Aggregation-Liquid-Applying Step

A material in which a surface of a 0.5-mm PET film was coated with silicone rubber (trade name; High Precision Ultrathin SR Sheet manufactured by Tigers Polymer Corporation) so as to give a thickness of 0.2 mm was prepared. The surface of the material was hydrophilized using a parallel flat plate type atmospheric pressure plasma treatment apparatus (APT-203 manufactured by SEKISUI CHEMICAL CO., LTD.) to produce an intermediate transfer member to be used in this example. The application of the aggregation liquid to the intermediate transfer member was performed in a coating amount of 5.0 g/m$^2$ in a liquid state using a roll coater.

(B) Intermediate-Image-Forming Step

The above-mentioned ink was applied to an image formation surface of the intermediate transfer member to which the aggregation liquid has been applied with an ink jet device (nozzle array density: 1,200 dpi, ejection amount: 4 μl) to form an intermediate image.

(C) Transferring Step

The intermediate image on the intermediate transfer member was dried. After the drying, a recording medium (printing paper sheet, trade name; Kinbishi, basis weight; 127.9 g/m$^2$, manufactured by Mitsubishi Paper Mills Ltd.) was pressed on the image formation surface of the intermediate image with a pressure roller, to thereby transfer the intermediate image to the recording medium.

(D) Fixing Step

The recording medium having the intermediate image transferred thereto was heated with hot air at 100° C. for 5 minutes to fix the image. Thus, the recording medium having a final image formed thereon was obtained.

Table 6 below shows the ink and the aggregation liquid used in each of Examples and Comparative Examples. It should be noted that the term "Amine value/Acid value" in Table 6 means a ratio of an amine value of a polymer compound contained in an aggregation liquid with respect to the total acid value of an anionic component in ink.

TABLE 6

| | Ink | Aggregation liquid | Amine value/Acid value |
|---|---|---|---|
| Example 1 | Black ink 1 | Aggregation liquid 1 | 2.0 |
| Example 2 | Black ink 1 | Aggregation liquid 2 | 1.7 |
| Example 3 | Black ink 1 | Aggregation liquid 3 | 4.0 |
| Example 4 | Black ink 1 | Aggregation liquid 4 | 2.0 |
| Example 5 | Black ink 1 | Aggregation liquid 5 | 2.0 |
| Example 6 | Black ink 2 | Aggregation liquid 1 | 9.8 |
| Comparative Example 1 | Black ink 1 | Comparative aggregation liquid 1 | 6.1 |
| Comparative Example 2 | Black ink 1 | Comparative aggregation liquid 2 | 2.7 |
| Comparative Example 3 | Black ink 1 | Comparative aggregation liquid 3 | 2.0 |
| Comparative Example 4 | Black ink 2 | Comparative aggregation liquid 3 | 9.8 |
| Comparative Example 5 | Black ink 1 | Comparative aggregation liquid 4 | — |
| Comparative Example 6 | Black ink 2 | Comparative aggregation liquid 4 | — |

<Evaluation>

In the intermediate-image-forming step in the above-mentioned recording method, intermediate images each measuring 2 cm by 2 cm were formed on the intermediate transfer member at recording densities of 10% duty, 100% duty, and 350% duty. The resultant intermediate images were evaluated for their transferability to a recording medium, wet scratch resistance, and bleeding based on the following criteria.

<Transferability>

The intermediate transfer members after the transferring step were observed with an optical microscope, and the ink remaining area ratio of each of the intermediate images was evaluated based on the following criteria. The remaining area ratio was calculated by image processing of image data obtained with the optical microscope. A case where the whole ink is transferred to the recording medium and no intermediate image remains is defined as a remaining area ratio of 0%.

A: The remaining area ratio of ink on an intermediate transfer member is 0% or more and less than 5%.

B: The remaining area ratio of ink on an intermediate transfer member is 5% or more and less than 10%.

C: The remaining area ratio of ink on an intermediate transfer member is 10% or more and less than 20%.

D: The remaining area ratio of ink on an intermediate transfer member is 20% or more and less than 30%.

E: The remaining area ratio of ink on an intermediate transfer member is 30% or more.

<Wet Scratch Resistance>

A final image (2 cm by 2 cm) obtained by transferring an intermediate image measuring 2 cm by 2 cm to a recording medium was evaluated for its wet scratch resistance. First, the final image formed was measured for its optical density (O.D.). Next, 0.2 ml of one water droplet was dropped on the final image and left to stand for 3 minutes. After that, scratch wiping (wet scratch) was performed with a lens-cleaning paper sheet, and the O.D. at the center position of a portion at which the water droplet was dropped was measured. Based on those measurement results, the O.D. retention rate was evaluated based on the following criteria. It should be noted that the "O.D. retention rate equals to 100×(O.D. after wet scratch)/(O.D. before wet scratch)." The "O.D." was measured using a spectrophotometer (trade name; Spectrolino manufactured by Gretag Macbeth Co.).

A: The O.D. retention rate is 99% or more.

B: The O.D. retention rate is 95% or more and less than 99%.

C: The O.D. retention rate is 90% or more and less than 95%.

D: The O.D. retention rate is 80% or more and less than 90%.

E: The O.D. retention rate is 60% or more and less than 80%.

<Bleeding>

By the above-mentioned recording method, after the aggregation liquid had been applied to the entire surface of the intermediate transfer member, a regular square (100% duty) measuring 2 cm by 2 cm was formed with Black ink 1. Immediately after the formation, regular squares (100% duty) each measuring 2 cm by 2 cm were formed with Cyan ink 1, Yellow ink 1, and Magenta ink 1 so as to be adjacent to three sides of the above-mentioned square. In the same manner as above, patterns having the four squares of 10% duty and four squares of 300% duty were also formed. Next, a boundary portion between intermediate images on the intermediate transfer member was observed with an optical microscope. The boundary portion is a boundary portion between the square formed with Black ink 1 and the square formed with Cyan ink 1, a boundary portion between the square formed with Black ink 1 and the square formed with Yellow ink 1, or a boundary portion between the square formed with Black ink 1 and the square formed with Magenta ink 1. Then, regarding a bleeding portion at which bleeding occurred most remarkably among the respective boundary portions, the degree of a ratio of an area of the bleeding portion with respect to an area of one square was calculated by image processing and evaluated based on the following criteria.

A: The bleeding area ratio is less than 0.1%.

B: The bleeding area ratio is 0.1% or more and less than 1.0%.

C: The bleeding area ratio is 1.0% or more and less than 10.0%.

D: The bleeding area ratio is 10.0% or more.

Table 7 below shows the evaluation results obtained as described above.

TABLE 7

| Printing | Transferability | | | Wet scratch resistance | | | Bleeding | | |
|---|---|---|---|---|---|---|---|---|---|
| duty (%) | 10 | 100 | 350 | 10 | 100 | 350 | 10 | 100 | 300 |
| Example 1 | A | A | A | B | A | A | A | A | A |
| Example 2 | A | A | A | B | A | A | A | A | A |
| Example 3 | A | A | A | B | B | A | A | A | A |
| Example 4 | A | A | B | B | A | A | A | A | A |
| Example 5 | A | A | B | B | B | B | A | B | B |
| Example 6 | A | B | B | B | B | B | A | B | B |
| Comparative Example 1 | B | B | C | C | C | D | B | B | C |
| Comparative Example 2 | B | B | C | C | C | D | B | B | C |
| Comparative Example 3 | B | B | C | C | C | D | B | C | D |
| Comparative Example 4 | B | B | C | C | D | D | B | C | D |
| Comparative Example 5 | C | D | D | E | E | E | B | C | D |
| Comparative Example 6 | C | D | D | E | E | E | C | C | D |

Each of Examples 1 to 6, which is the transfer ink jet recording method of the present invention, is satisfactory in all of transferability, wet scratch resistance, and bleeding.

In contrast, in the transfer ink jet recording method of each of Comparative Examples 1, 2, 5, and 6 in which the aggregation liquid does not include the polymer compound of the present invention was not satisfactory in any of transferability, wet scratch resistance, and bleeding. Further, the transfer ink jet recording method of each of Comparative Examples 3 and 4 in which the aggregation liquid does not contain any aggregating agent was also not satisfactory in any of transferability, wet scratch resistance, and bleeding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-258193, filed Nov. 18, 2010, which is hereby incorporated by reference herein in its entirety.

What is claimed is:

1. A transfer ink jet recording method, comprising:

forming an intermediate image by applying ink comprising an anionic component to an image formation surface of an intermediate transfer member to which an aggregation liquid comprising an aggregating agent for aggregating the anionic component in the ink has been applied by an ink jet recording method; and transferring the intermediate image from the image formation surface having the intermediate image formed thereon to a recording medium by pressing the recording medium to the image formation surface, wherein the aggregation liquid further comprises a polymer compound including one of a polyamino acid and a polyamino acid salt each having an amino group, each of which is obtained by polymerization of an amino acid compound represented by general formula (1):

general formula (1)

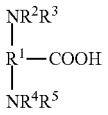

where $R^1$ represents a trivalent organic group; $R^2$, $R^3$, $R^4$, and $R^5$ each represent hydrogen or a monovalent organic group; and at least one of $R^2$, $R^3$, $R^4$, and $R^5$ represents hydrogen.

2. The transfer ink jet recording method according to claim 1, wherein the amino acid compound represented by the general formula (1) comprises any one of the group consisting of lysine, ornithine, arginine, asparagine, histidine, glutamine, and tryptophan.

3. The transfer ink jet recording method according to claim 1, wherein the polymer compound has an amine value of 5.0 mmol/g or more and 16.0 mmol/g or less.

4. The transfer ink jet recording method according to claim 1, wherein the ink comprises a dispersant.

5. The transfer ink jet recording method according to claim 1, wherein the aggregating agent comprises one of a metal salt and an acidic compound.

6. The transfer ink jet recording method according to claim 5, wherein the aggregating agent comprises an acidic compound having an acid dissociation constant of 4.5 or less.

7. The transfer ink jet recording method according to claim 3, wherein the polymer compound has the amine value that is 1.0 or more and 2.5 or less times as large as a total acid value of the anionic component in the ink.

8. The transfer ink jet recording method according to claim 1, wherein a content of the aggregating agent in the aggregation liquid is 0.01 mass % or more and 90 mass % or less with respect to a total mass of the aggregation liquid, and wherein a content of the polymer compound in the aggregation liquid is 1 mass % or more and 90 mass % or less with respect to the total mass of the aggregation liquid.

9. The transfer ink jet recording method according to claim 1, wherein a content of the aggregating agent in the aggregation liquid is 10 mass % or more and 70 mass % or less with respect to a total mass of the aggregation liquid, and wherein a content of the polymer compound in the aggregation liquid is 10 mass % or more and 50 mass % or less with respect to the total mass of the aggregation liquid.

10. The transfer ink jet recording method according to claim 5, wherein the metal salt is a metal salt that generates a polyvalent metal ion selected from the group consisting of $Ca^{2+}$, $Cu^{2+}$, $Ni^{2+}$, $Mg^{2+}$, $Zn^{2+}$, $Fe^{3+}$, and $Al^{3+}$.

11. The transfer ink jet recording method according to claim 5, wherein the acidic compound is selected from the group consisting of polyacrylic acid, acetic acid, methanesulfonic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, levulinic acid, derivatives of those compounds, and salts thereof.

* * * * *